United States Patent [19]

Bubik et al.

[11] 4,430,159

[45] Feb. 7, 1984

[54] TWIN-WIRE PAPERMAKING MACHINE

[75] Inventors: Alfred Bubik, Ravensburg; Siegfried Reutter, Gerbertshaus, both of Fed. Rep. of Germany

[73] Assignee: Escher Wyss Limited, Ravensburg, Fed. Rep. of Germany

[21] Appl. No.: 367,076

[22] Filed: Apr. 9, 1982

[30] Foreign Application Priority Data

Apr. 27, 1981 [CH] Switzerland ..... 2727/81

[51] Int. Cl.[3] ..... D21F 1/00

[52] U.S. Cl. ..... 162/292; 162/123; 162/213; 162/214; 162/298; 162/299; 162/300; 162/301; 162/315; 162/317

[58] Field of Search ..... 162/214, 123, 292, 298, 162/299, 300, 301, 315, 316, 317, 297, 213

[56] References Cited

U.S. PATENT DOCUMENTS 2,062,442 12/1936 Charlton ..... 162/299
4,158,596 6/1979 Justus ..... 162/301

FOREIGN PATENT DOCUMENTS 102798 10/1941 Sweden ..... 162/316

*Primary Examiner*—Peter Chin
*Attorney, Agent, or Firm*—Werner W. Kleeman

[57] ABSTRACT

A twin-wire papermaking machine contains a region having two wires guided in mutual contact with one another and at which there is located at least one stock infeed device. The stock infeed device possesses the form of a box or cabinet member having an open side along which move both of the wires. Within the stock infeed device there is located a fibrous stock suspension suitable for the fabrication of paper and which is at an excess pressure in relation to the atmosphere. At the side of the wires facing away from the stock infeed device there can be arranged a suction device.

11 Claims, 3 Drawing Figures

TWIN-WIRE PAPERMAKING MACHINE

BACKGROUND OF THE INVENTION

The present invention relates to a new and improved construction of a twin-wire papermaking machine containing two mutually parallely extending wires which are moved essentially at the same velocity or speed of movement, and at least one device for the infeed of a fiber stock suspension through one of the wires.

Twin-wire papermaking machines of this type are known to the art, for instance from U.S. Pat. No. 2,062,445 and U.S. Pat. No. 4,158,596. With both of these state-of-the-art papermaking machines there is employed a so-called distribution wire which is guided at a certain spacing from the main wire and upon which there is sprayed the fiber stock suspension from special spray nozzles. This fiber stock suspension penetrates the distribution wire and deposits upon the main wire.

Such construction is afflicted with a spate of drawbacks. Thus, for instance, it is extremely difficult to guide the wires parallel to one another and at a not too great spacing from one another. Additionally, the danger exists that the wires will oscillate, especially the distribution wire, so that there is disturbed the uniformity of the distribution of the fiber stock suspension.

SUMMARY OF THE INVENTION

Therefore, with the foregoing in mind it is a primary object of the present invention to provide a new and improved construction of a twin-wire papermaking machine which is not afflicted with the aforementioned drawbacks and limitations of the prior art.

Another and more specific object of the present invention is directed to a new and improved construction of a twin-wire papermaking machine wherein the aforementioned disadvantages are not present, and additionally, wherein there is afforded a series of new and appreciable advantages not heretofore attainable with such type twin-wire papermaking machine.

Still a further significant object of the present invention is directed to a new and improved construction of a twin-wire papermaking machine which renders possible a simplification of the guiding of both wires as well as a simplification of the stock infeed device, and improves upon the possibilities available during the fabrication of paper, especially also affords the possibility of fabricating novel types of paper.

Now in order to implement these and still further objects of the invention, which will become more readily apparent as the description proceeds, the twin-wire papermaking machine of the present development is manifested by the features that the wires are guided to be in mutual contact with one another at least at the region of the stock infeed device. The stock infeed device possesses the form of a stock infeed box having an open side along which move both of the wires. The stock suspension within the stock infeed box possesses at the region of the wires an excess pressure in relation to the atmospheric pressure.

By virtue of the fact that the wires are guided so as to be in mutual contact with one another there is simplified the guiding of the wires, since only one of the wires need be guided. The stock infeed device, in the form of a stock infeed box, is likewise simpler in construction than a large number of spray nozzles. Additionally, with this design there is dispensed with the problems of uniformly distributing the fiber stock suspension to the individual spray nozzles and then from the spray nozzles to the main wire. Also, with the inventive construction of twin-wire papermaking machine there are avoided the problems which arise with the standard headboxes as concerns the turbulence of the stock suspension, since this turbulence is automatically produced due to the movement of the wire at the box of the stock infeed device.

The twin-wire papermaking machine of the present development enables the fabrication of paper having randomly thin plies of low or, in fact, no wet strength with controlable ply separation precision. In contrast to papermaking machines working with conventional headboxes there does not exist any danger of disturbing the already formed web by an incoming suspension jet. Furthermore, there are possible different novel effects, such as, for instance, the formation of a velvet-like surface for tissue paper. Additionally, the inventive papermaking machine can be operated at increased stock densities, something resulting in savings in energy.

In this connection reference is made to German Patent Publication No. 1,904,962, published Aug. 20, 1970, and German Patent Publication No. 1,942,348, published Mar. 4, 1971, which disclose twin-wire papermaking machines wherein the wires are guided so as to be in mutual contact with one another and there are provided externally arranged spray devices. However, these spray devices do not serve for the infeed of fibrous stock suspensions, rather for the infeed of additive materials.

Preferably, the wires can be guided at the region of the stock infeed device so as to undergo a change in direction and are pressed against one another by the force resulting from the wire tension. Consequently, there is obtained the requisite contact force of the wires against one another through the use of particularly simple means.

According to a possible construction of the invention the stock infeed box of the stock infeed device can be arranged within a perforated roll or cylinder over which there are guided the wires. The stock infeed box is sealingly arranged within the perforated roll or cylinder. As a result, there is obtained a device which is not unlike a suction roll, with the difference, however, that within the stock infeed box there prevails an excess pressure and there is infed the stock suspension to the stock infeed box. Due to the wrapping of the wire there is obtained a uniform pressing of the wires against one another throughout the wrap angle.

It should be understood that for increasing the effect of the stock infeed device there can be provided a suction device which is arranged at the region of the stock infeed device at the side of the wires facing away from the stock infeed device.

Preferably, the stock infeed device, viewed with regard to the direction of movement of the wires, can have arranged thereafter i.e. downstream thereof, a device for the removal of excess fibers adhering to the outside or outer surface of the wire.

The device for the removal of excess fibers can be constituted by a scraper ledge or doctor blade or equivalent structure.

However, the device for the removal of excess fibers also can comprise a rotatable cylinder or roll having a smooth surface upon which adhere the fibers and from which they thereafter can be scraped-off.

Particular advantages can be obtained by the sequential arrangement of a plurality of stock infeed devices at one or at different sides or faces of the wires. In this way there can be fabricated in a most advantageous manner, with appreciably simpler means than heretofore possible, multi-ply paper. However, it should be understood that by virtue of the use of the inventive stock infeed devices it is possible to infeed or input not only fiber stock suspensions but also suspensions or other stock used during the fabrication of paper, such as for instance filler stock.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures there have been generally used the same reference characters to denote the same or analagous components and wherein.

DETAILED DESCRIPTION OF THE PREFERRED EMBODIMENTS

Figure 1:
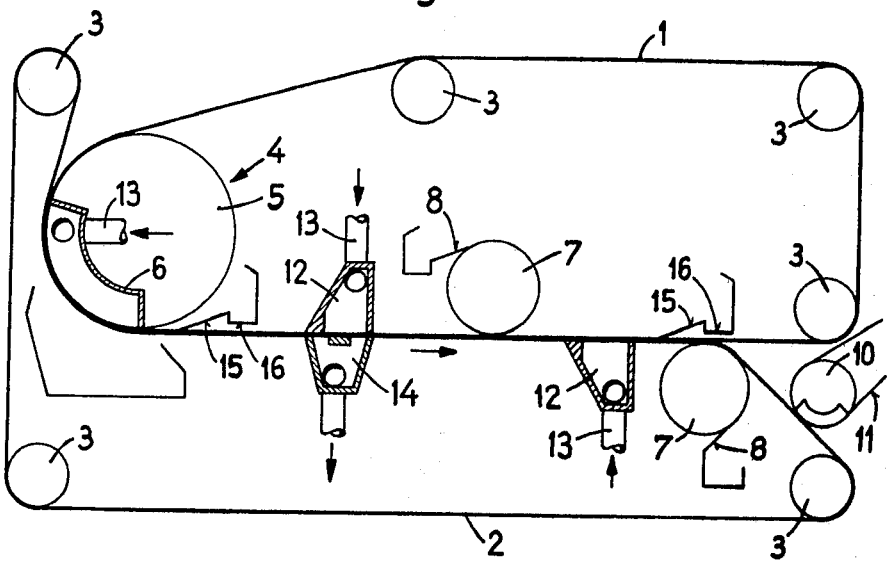
FIG. 1 schematically illustrates a first exemplary embodiment of twin-wire papermaking machine.

Describing now the drawings, and turning attention to the first exemplary embodiment of twin-wire papermaking machine depicted in FIG. 1, it will be seen that such comprises an upper wire 1 and a lower wire 2. The upper wire 1 is guided over guide rolls 3, a stock infeed device 4 in the form of a perforated roll or cylinder 5, within which there is sealingly arranged a stock infeed box 6, as well as a cylinder 7 for the removal of excess fibers from the inner side or face of the wire 2. The cylinder 7 has a smooth outer surface and is provided with a scraper ledge or doctor blade 8 serving for the removal of material which adheres to the surface of the cylinder 7.

The lower wire 2 is guided over further guide rolls 3, wrapped together with the wire 1 about the perforated roll or cylinder 5, guided over a further scraper roll 7 equipped with a scraper ledge 8 or equivalent structure and is equipped with a pick-up or take-off roll 10 which serves for the pick-up of a formed paper web 11.

According to the invention there is provided in addition to the stock infeed box 6 of the perforated roll or cylinder 5 two further stock infeed boxes 12. These stock infeed boxes 12 are connected, in the same manner as the stock infeed box 6, at tubular conduits or lines 13 which serve, in the same fashion as for the conventional headbox devices, for the infeed of a fiber stock suspension. The first stock infeed box 12, viewed in the direction of movement of the wires 1 and 2, coacts with a suction box 14 which is arranged at the other side of both wires 1 and 2. The two wires 1 and 2 pass between the stock infeed box 12 and the suction box 14. Finally, within the upper wire 1 there is arranged after the perforated roll 5 and the second stock infeed box 12 the scrapper or stripper ledges 15 or equivalent structure equipped with schematically illustrated withdrawal or outflow troughs 16 or the like.

During operation, stock suspension is infed at a suitable pressure to the stock infeed boxes 6 and 12, such stock suspension is then expressed through the mesh of the wire bounding at the related stock infeed boxes 6 and 12, and then passes through both of the wires 1 and 2. By means of the stock infeed box 6 of the perforated roll or cylinder 5 there is formed between both of the wires 1 and 2 a first ply or layer upon which there is then deposited from both sides or faces a respective further ply or layer by the following stock infeed boxes 12. The scraper ledges 15 and the scraper cylinder 7 serve for the removal of the fiber material adhering to the outer surface of the related wire.

With a papermaking machine of the type disclosed in FIG. 1 it is possible to fabricate a triple-ply material wherein the individual plies or layers can consist of fiber stock material having different properties.

Figure 2:
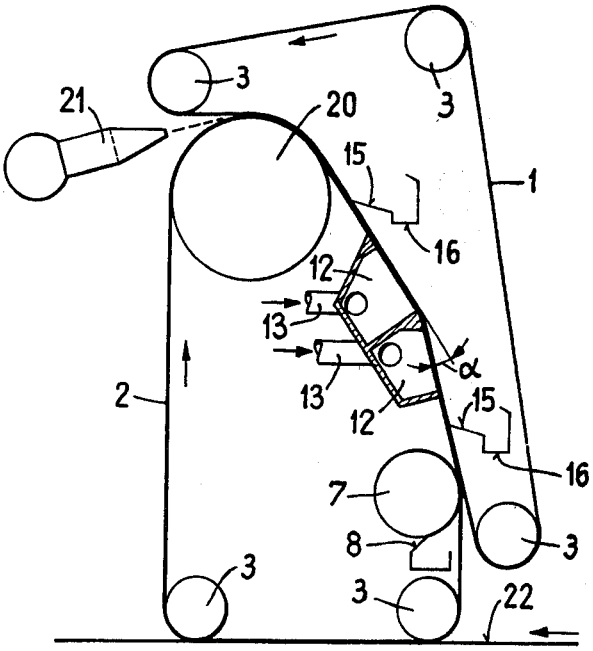
FIG. 2 schematically illustrates a second exemplary embodiment of twin-wire papermaking machine.

The papermaking machine shown in the modified construction of FIG. 2 differs from the papermaking machine disclosed above with reference to FIG. 1 predominantly by virtue of the fact that the stock infeed device 4 is replaced in this case by a solid roll or cylinder 20, and the first stock infeed is accomplished between both of the wires 1 and 2 by means of a conventional headbox 21. Additionally, there are provided two stock infeed boxes 12, whose not particularly referenced guide surfaces for both of the wires 1 and 2 are disposed at an angle with respect to one another. Also in this case both of the stock infeed boxes 12 are connected to infeed lines or conduits 13 for the stock suspension.

With the papermaking machine depicted in FIG. 2 there is formed between both of the wires 1 and 2 a first ply of fiber material with the aid of the headbox 21 in conventional manner. Upon this formed ply or layer there can be applied by the stock infeed boxes 12 two further plies or layers of a desired fiber stock material. The formed paper web thereafter can be deposited, for instance, upon a felt 22.

Figure 3:
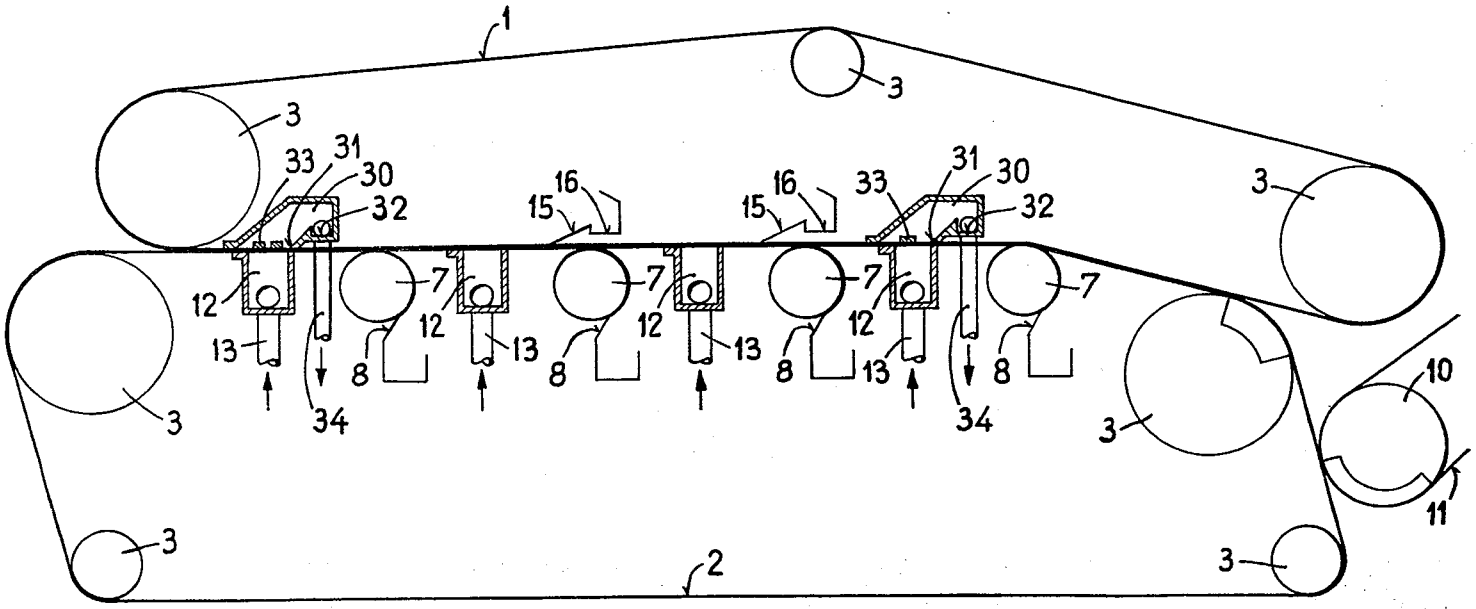
FIG. 3 schematically illustrates a third embodiment of twin-wire papermaking machine.

With the variant construction of papermaking machine depicted in FIG. 3 there are arranged in succession at the wire 2 four stock infeed boxes 12. Each stock infeed box 12 has operatively associated therewith a scraper or stipper roll 7. Additionally, at the upper side of the wire section there are provided within the upper wire 1 the scrapper or stripper ledges or ledge memebers 15 provided with the outflow channels 16.

Operatively associated with the first and the last stock infeed boxes 12 is a respective withdrawal or suction box 30 equipped with a scraper edge 31 and an outflow trough or vat 32. Within each box 30 there is provided at least one schematically illustrated support ledge 33 for the wires 1 and 2. The withdrawal or suction boxes 30 are connected with outflow lines or conduits 34 which serve for the removal of the scraped-off liquid and, depending upon requirements, also can be connected to a related suction line.

With the embodiment of FIG. 1 both of the wires 1 and 2, during such time as they are trained about the perforated roll or cylinder 5, undergo a change in direction, so that these wires 1 and 2 are pressed by the wire tension force against the surface of the perforated roll or cylinder 5 and also against one another. The same action is obtained with the embodiment of FIG. 2 by the angle $\alpha$ between both of the stock infeed boxes 12. Otherwise there is ensured for a mutual contact of both of the wires by the provision of boxes 14 or 30 arranged at the opposite side or by the scraper ledges 15.

While there are shown and described present preferred embodiments of the invention, it is to be distinctly understood that the invention is not limited thereto, but may be otherwise variously embodied and practiced within the scope of the following claims. Accordingly,

What we claim is:

1. A twin-wire papermaking machine comprising:

two wires extending essentially parallel to one another and moving essentially at the same speed;

at least one stock infeed means for the pressurized infeed of a fiber stock suspension at above atmospheric pressure between both of the wires through one of said wires in order to form a paper ply between the two wires from the infed fiber stock suspension;

means for guiding said wires so as to be in mutual contact with one another at least at the region of the stock infeed means;

said stock infeed means possessing the form of a box member having an open side along which move both of the wires; and said stock infeed means has a guide surface at the open side thereof which is in guiding contact with one of the two wires located adjacent thereto in order to press said one wire against the other wire.

2. The twin-wire papermaking machine as defined in claim 1, wherein:

said means for guiding the wires includes structure located at the region of the stock infeed means for causing the wires to undergo a change in direction, so that by virtue of a force resulting from the wire tension the wires are pressed against one another.

3. The twin-wire papermaking machine as defined in claim 2, wherein:

said structure of said guiding means includes a perforated roll within which there is sealingly guided the box member of the stock infeed means and over which there are guided said wires.

4. The twin-wire papermaking machine as defined in claim 1, further including:

a suction device arranged at the region of the stock infeed means and at a side of the wires facing away from the stock infeed means.

5. The twin-wire papermaking machine as defined in claim 1, wherein:

said stock infeed means, viewed with respect to the direction of movement of the wires, is provided with a means for the removal of excess fibers adhereing to an outer surface of at least one of the wires.

6. The twin-wire papermaking machine as defined in claim 5, wherein:

said means for the removal of excess fibers comprises a scraper ledge member.

7. The twin-wire papermaing machine as defined in claim 5, wherein:

said means for the removal of excess fibers comprises a rotatable cylinder having a smooth cylinder surface.

8. The twin-wire papermaking machine as defined in claim 1, wherein:

a plurality of said stock infeed means are arranged in succession along said wires.

9. The twin-wire papermaking machine as defined in claim 1, wherein:

said at least one stock infeed means is located to one side of one of the wires and is in contact with said one wire at said open side of said at least one stock infeed device.

10. The twin-wire papermaking machine as defined in claim 9, wherein:

said at least one stock infeed means contactingly cooperates with said at least one wire in order to generate turbulence in the fiber stock suspension infed by said at least one stock infeed device.

11. The twin-wire papermaking machine as defined in claim 1, wherein:

said stock infeed means feeds the fiber stock suspension between the two wires at an excess pressure.

* * * * *